United States Patent [19]

Scheurecker

[11] 4,007,822

[45] Feb. 15, 1977

[54] STRAND GUIDING MEANS TO BE USED IN A CONTINUOUS CASTING PLANT

[75] Inventor: Werner Scheurecker, Linz, Austria

[73] Assignee: Vereinigte Osterreichische Eisen- und Stahlwerke - Alpine Montan Aktiengesellschaft, Linz, Austria

[22] Filed: Mar. 19, 1976

[21] Appl. No.: 668,587

[30] Foreign Application Priority Data

Mar. 25, 1975 Austria ..... 2266/75

[52] U.S. Cl. ..... 193/35 R; 72/248; 164/282

[51] Int. Cl.[2] ..... B22D 11/12

[58] Field of Search ..... 164/282; 72/248; 193/35 R

[56] References Cited

UNITED STATES PATENTS 3,757,848 9/1973 Scholz et al. ..... 164/282

FOREIGN PATENTS OR APPLICATIONS 597,413 5/1934 Germany ..... 72/248

*Primary Examiner*—Robert D. Baldwin
*Attorney, Agent, or Firm*—Brumbaugh, Graves, Donohue & Raymond

[57] ABSTRACT

A strand guiding means has at least two framing parts arranged in pairs and opposite each other, which are connected by drawing anchors. Upon each of the drawing anchors an outer and an inner bushing, having corresponding helical sliding faces and an angle of inclination that is smaller than the pertaining angle of friction, are arranged. Each one of the inner bushings is rotated relative to the outer bushing by a pressure medium cylinder, whereby one of the two framing parts is movable and the strand guiding rollers accommodated by the framing parts are brought into and out of an engagement position.

6 Claims, 4 Drawing Figures

STRAND GUIDING MEANS TO BE USED IN A CONTINUOUS CASTING PLANT

BACKGROUND OF THE INVENTION

The invention relates to a strand guide in a continuous casting plant having frame or stand parts, lying opposite each other in pairs and being connected by drawing anchors for accommodating the strand guide rollers, and a relief means having a pressure medium cylinder.

When operational disturbances cause a stand-still of the continuous casting plant during casting, the already greatly cooled strand may get stuck when conveyed, whereby strand guide parts may be damaged or a rupture of the strand may be caused.

A known strand guide (German Offenlegungsschrift No. 2,062,792) has a relief means for detaching the strand guide rollers from the strand, consisting of two wedges arranged with their inclined faces toward each other. One of the wedges is displaceable along a slide path relative to the other one in the horizontal direction. The wedge angles are bigger than the angles of friction so that the two wedges slide upon each other when the displacement path is not limited. As a result the strand guiding rollers arranged on both sides of the strand and facing each other can be moved apart. The displacement path of the two wedges is limited in this construction by a further wedge that is adjustable by means of a pressure medium cylinder which is withdrawn in case of a disturbance, thus freeing the displacement path. During casting the pressure medium cylinder must always be actuated, otherwise the ferrostatic pressure of the strand would press the three wedges apart. An undesired loss of pressure thus also causes a yielding of the strand guide parts and consequently the strand may bulge. A further disadvantage of the known relief means is that the wedges, after an actuation of the relief means for freeing the strand, must be made to slide upon one another and on the partly open slide paths by a force to be created by the strand, and this is complicated by pollution or grit along the slide path and the influence of temperature on the shape of the path during the rough casting operation.

Summary of the Invention

The invention aims at preventing the above mentioned disadvantages and difficulties and has as its object to create a strand guide of the above described kind whose relief means is self-locking, i.e. the strand parts do not move during unintended losses of pressure, and whose relief means, when it has been actuated, allows the frame or stand parts to freely move apart without a restricting wedge or the like having to be moved along on a dirty slide path by the strand.

According to the invention this object is achieved in that the drawing anchors on one side of the frame or stand part are provided with two bushings that have corresponding helical slide faces having an angle of inclination that is smaller than the pertaining angle of friction. The outer bushing is always fixedly connected to the drawing anchor and the inner bushing, which is supported on the frame part, is rotatable relative to the outer bushing by means of a pressure medium cylinder, whereby one frame or stand part is movable and thus the rollers can be brought into and out of the engagement position.

It is suitable that the movable frame or stand part can be supported on annular consoles connected to the drawing anchor. Advantageously, exchangeable spacers are insertable between the consoles and the movable frame or stand part, and between the movable frame or stand part, and the inner bushings for adjusting a pre-determined distance between the rollers.

According to a preferred embodiment, the movable framing or stand part is connected with a fixed point on the opposite framing or stand part or on the drawing anchor by a pressure medium cylinder. Between the movable framing or stand part and the inner bushings exchangeable spacers are insertable for adjusting a given roller distance. This embodiment may also be used for an infinitely variable adjustment of the distance between the strand guide rollers. First, the general adjustment to the given strand thickness is effected by means of the spacers, while for a precise adjustment the rotatable bushings are rotated until the rollers of the framing or stand part that is movable by the pressure medium cylinder, are precisely at the distance of the thickness of the strand above the rollers of the fixed stand part. A further rotation of bushing causes a relief or space between the rollers and the strand. It is especially advantageous to surround the bushings by a protective sleeve. Thus the helical slide faces of the bushings are reliably protected from dirt.

BRIEF DESCRIPTION OF THE DRAWINGS

The invention shall now be described in more detail and with reference to the accompanying drawings, wherein.

DESCRIPTION OF EXEMPLARY EMBODIMENTS

Figure 1:
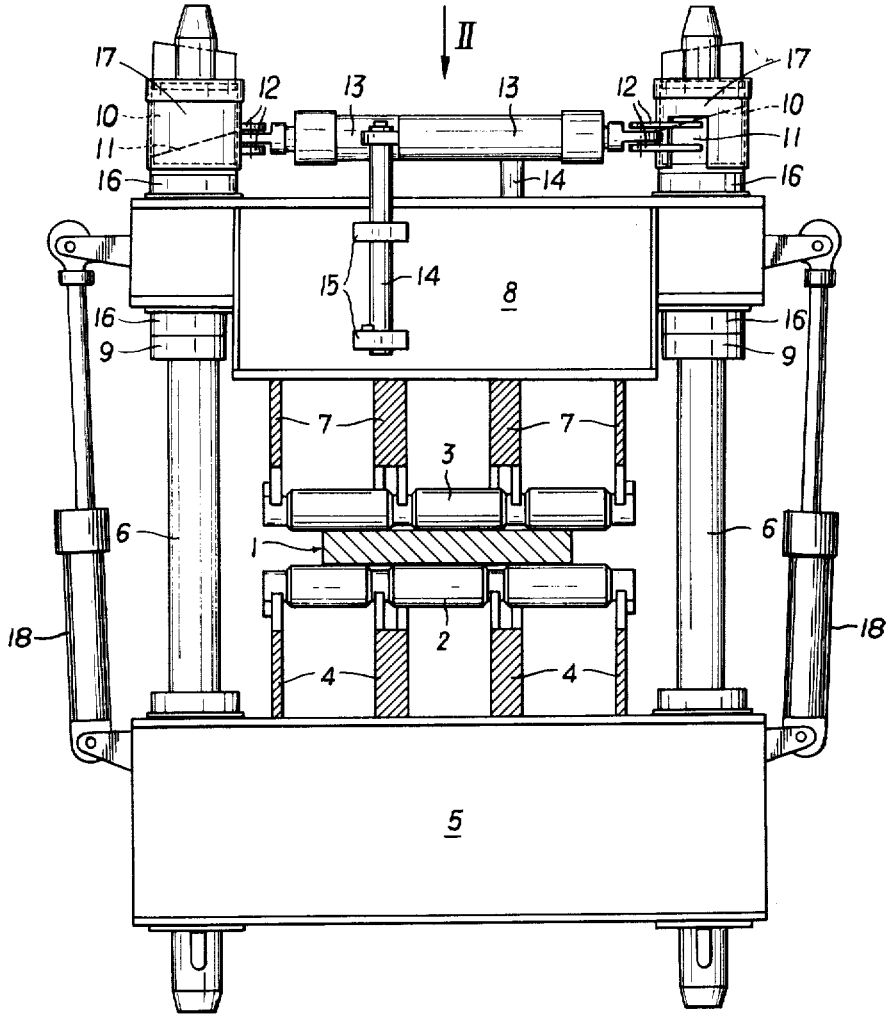
FIG. 1 is a view of the strand guide in the direction of the longitudinal axis of the strand according to one embodiment.
Figure 2:
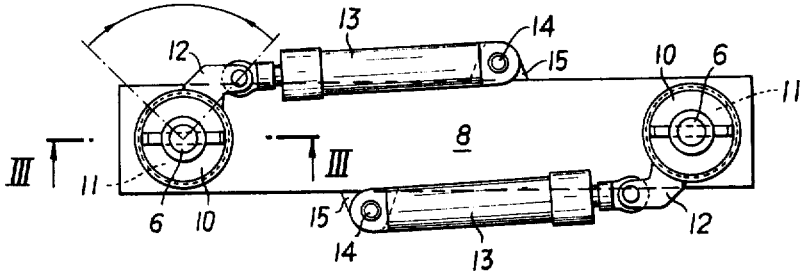
FIG. 2 is a view in the direction of the arrow II of FIG. 1.

With reference number 1 a cast strand is denoted, which is extracted from a mould (not shown) and guided between supporting rollers 2 and 3 lying opposite each other. The rollers 2 supporting the strand at its outer or lower side are — via longitudinal carriers 4 — mounted on a base-supported framing or stand part 5 at whose ends one drawing anchor 6 each is rigidly secured. The strand guiding rollers 3 arranged at the inner or upper side of the strand are mounted — via longitudinal carriers 7 — on a framing or stand part 8 that is displaceable along the drawing anchors 6 by means of pressure cylinders 18 connected between framing parts 5 and 8. Both of the drawing anchors have annular consoles 9 restricting the movement of the framing part 8 in the direction of the framing part 5. The movement of the framing part 8 in the opposite direction is restricted by two bushings 10 and 11, placed upon each one of the drawing anchors 6. These bushings form a thread with their helical slide faces corresponding to each other. Each of the outer bushings 10 is fixedly connected to a drawing anchor, whereas the inner bushings 11 are mounted to be rotatable around the drawing anchors. For actuating the rotatable bushings 11, one pressure medium cylinder 13 each is provided, whose piston rod is articulately connected to lever-like projections 12 of the bushings 11. The pressure medium cylinder 13 is hinged to a pin 14, which is secured to the movable frame part 8 by two brackets 15 so as to be displaceable in the same direction as frame part 8. For setting the rollers at a pre-determined distance, horseshoe-shaped spacers 16 surrounding the drawing anchor are inserted between the consoles 9 and the movable framing part as well as between the framing part 8 and the rotatable bushings 11. By using spacers of different thicknesses, the distance between the strand guiding rollers 2 and 3 can be altered; however, the total thickness of all the spacers inserted on the two sides of the framing part 8 has to remain constant. The motion of framing part 8 during the placement of the spacers is by means of pressure cylinders 18.

Before the continuous casting is started and after the strand guide has been adjusted to the desired strand thickness, the rotatable bushings 11 are moved into a clamped position by the pressure medium cylinders 13. This position is reached when the framing part 8 rests on the consoles 9 and the rotatable bushings 11 are braced relative to the frame 8 and relative to the bushings 10 rigidly connected to the drawing anchors. The frame part 8 thus is fixed between the annular consoles 9 and the bushings 11. The frame part 8 remains in this fixed position, even when the pressure medium cylinders 13 are no longer actuated, since the helical slide faces of the bushings 10 and 11 have an angle of inclination that is smaller than the pertaining angle of friction. An unintended loss of pressure thus does not cause a yielding of the strand guiding members.

If, in the course of casting, the strand gets stuck, the rotatable bushings 11 are rotated by an opposite actuation of the pressure medium cylinders 13 into a relief position, in which the framing part 8 is movable from the strand surface by an amount corresponding to the angle of rotation and the thread ascent. The bushings 10 and 11 are enveloped by a protective sleeve 17 reliably protecting the parts sliding upon each other against dirt, so that the friction conditions always remain constant.

Figure 4:
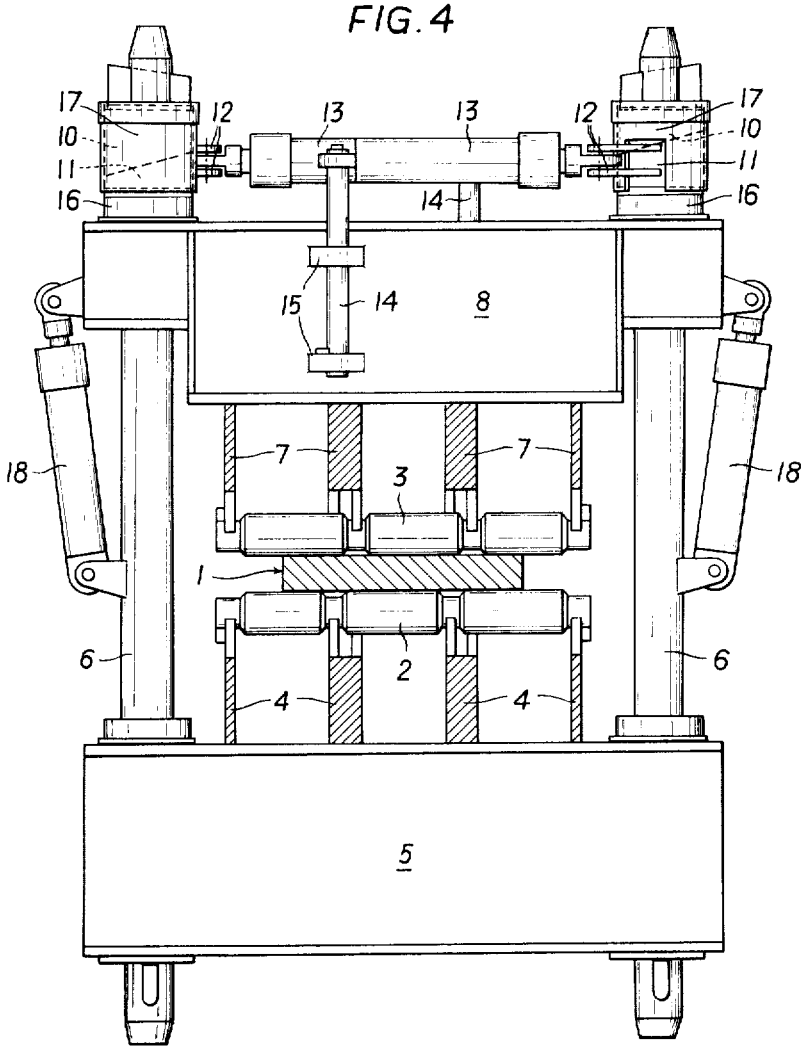
FIG. 4 is a view of a strand guide of the invention in the direction of the longitudinal axis of the strand according to another embodiment.
Figure 3:
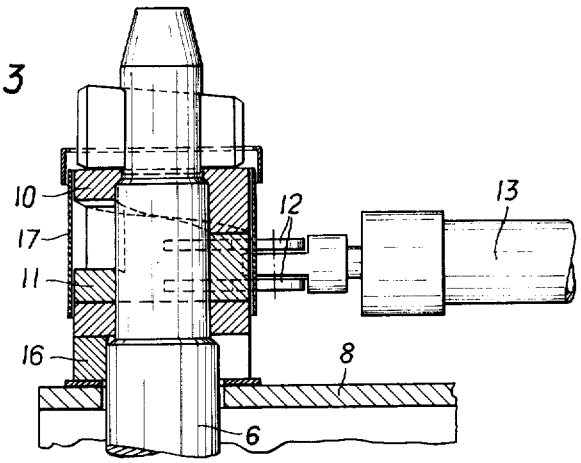
FIG. 3 is a section along line III—III of FIG. 2.

In FIG. 4 a preferred embodiment of the strand guide according to the invention is shown. The movable framing part 8 is connected with the drawing anchors by the two pressure medium cylinders 18 and is movable along the drawing anchors. If these pressure medium cylinders are actuated in the direction of the ferrostatic pressure, a distance between the strand guiding rollers results that is dependent on the rotation position of the bushings 11, the cylinders 18 and on the thickness of the spacers 16; thus the distance between the strand guiding rollers is infinitely variable by various positions of the bushing 11.

It is especially advantageous to provide the strand guide of the invention with a built-in overload indicator that automatically actuates the relief means when a pre-selected pressure upon the strand guiding rollers is exceeded. Such an overload indicator may consist, e.g., of a spring-mounted roller pressed to the strand, which roller swings out when a pre-selected pressure is exceeded and by this movement transmits an impulse to a relay. This relay then activates the pressure medium cylinders 13 so that they rotate the bushing 11 into the relief position.

What I claim is:

1. A strand guiding means to be used in a continuous casting plant comprising:

at least one first framing part;

at least one second framing part, the at least one first framing part and the at least one second framing part being arranged in pairs opposite each other;

drawing anchors connecting said at least one first framing part and said at least one second framing part;

strand guiding rollers supported by said at least one first framing part and said at least one second framing part;

bushing means for each of said drawing anchors adjacent said second framing part, each of said bushing means including an outer bushing fixedly connected to the drawing anchor and an inner bushing supported on said second framing part, said outer bushing and said inner bushing having corresponding mating helical sliding faces with an angle of inclination smaller than the pertaining angle of friction; and a pressure medium cylinder for each of the bushing means arranged to rotate said inner bushing relative to said outer bushing, whereby said second framing part is movable to bring the strand guiding rollers accommodated thereby into and out of engagement position.

2. A strand guiding means as set forth in claim 1, further comprising annular consoles connected with the drawing anchors and supporting the at least one second framing part.

3. A strand guiding means as set forth in claim 2, further comprising exchangeable spacers to be inserted between said annular consoles and said at least one second framing part as well as between said at least one second framing part and the inner bushings for adjusting a pre-determined distance between the strand guiding rollers.

4. A strand guiding means as set forth in claim 1, further comprising additional pressure medium cylinder means connecting the at least one second framing part with a fixed point on the at least one first framing part, and exchangeable spacers to be inserted between the at least one second framing part and the inner bushings for adjusting a pre-determined distance between the strand guiding rollers.

5. A strand guiding means as set forth in claim 1, further comprising additional pressure medium cylinder means connecting the at least one second framing part with a fixed point on the drawing anchors, and exchangeable spacers to be inserted between the at least one second framing part and the inner bushings for adjusting a pre-determined distance between the strand guiding rollers.

6. A strand guiding means as set forth in claim 1, further comprising a protecting sleeve for enveloping said bushing means.

* * * * *